US012697653B2

(12) United States Patent
Blanckaert et al.

(10) Patent No.: US 12,697,653 B2
(45) Date of Patent: Aug. 4, 2026

(54) METHOD FOR MANUFACTURING A LARGE-SIZED SEAMLESS DOME, AND CORRESPONDING DOME

(71) Applicant: AUBERT & DUVAL, Issy-les-moulineaux (FR)

(72) Inventors: Arnaud Blanckaert, Saint Gervazy (FR); Philippe Sagot, Pamiers (FR)

(73) Assignee: ALBERT & DUVAL, Issy-les-Moulineaux (FR)

( * ) Notice: Subject to any disclaimer, the term of this patent is extended or adjusted under 35 U.S.C. 154(b) by 0 days.

(21) Appl. No.: 19/111,928

(22) PCT Filed: Sep. 15, 2023

(86) PCT No.: PCT/EP2023/075451
§ 371 (c)(1),
(2) Date: Mar. 14, 2025

(87) PCT Pub. No.: WO2024/056868
PCT Pub. Date: Mar. 21, 2024

(65) Prior Publication Data

US 2026/0014616 A1 Jan. 15, 2026

(30) Foreign Application Priority Data

Sep. 16, 2022 (FR) ..... 2209363

(51) Int. Cl.
*B21D 22/02* (2006.01)
*B21D 22/20* (2006.01)
(Continued)

(52) U.S. Cl.
CPC ..... *B21D 51/24* (2013.01); *B21D 22/022* (2013.01); *B21D 22/208* (2013.01);
(Continued)

(58) Field of Classification Search
CPC .. B21D 22/185; B21D 22/022; B21D 22/208; B21D 51/24
See application file for complete search history.

(56) References Cited

U.S. PATENT DOCUMENTS 2,875,511 A 3/1959 Hawes
3,137,057 A 6/1964 Martin
(Continued)

FOREIGN PATENT DOCUMENTS

FR 2887611 A1 * 12/2006 ..... F17C 1/08
JP H06114479 A 4/1994
(Continued)

OTHER PUBLICATIONS

Translation of FR-2887611-A1 (Year: 2006).*
(Continued)

*Primary Examiner* — Jacob J Cigna
(74) *Attorney, Agent, or Firm* — NIXON & VANDERHYE

(57) ABSTRACT

A method for manufacturing a large-sized seamless dome, comprises providing a semi-finished product and hot forging by upsetting the semi-finished product to form a blank with a developed surface greater than that of the semi-finished product and less than the developed surface of the wall of the dome. The blank is hot formed to create a preform having a developed surface less than or equal to the developed surface of the wall. The preform comprises at least two consecutive portions extending radially in the continuation of one another away from the central axis, such that for all the portions, the average thicknesses and/or convexities of two consecutive portions are distinct. The preform undergoes hot deformation under a press between a die and a punch to form the wall.

18 Claims, 7 Drawing Sheets

(51) Int. Cl.

| | |
|---|---|
| ***B21D 35/00*** | (2006.01) |
| ***B21D 51/24*** | (2006.01) |
| ***B21J 1/06*** | (2006.01) |
| ***B21J 5/02*** | (2006.01) |

(52) U.S. Cl.
CPC ..... *B21D 35/006* (2013.01); *B21J 1/06* (2013.01); *B21J 5/022* (2013.01)

(56) References Cited

U.S. PATENT DOCUMENTS 3,263,315 A * 8/1966 O'Brien ..... B21K 1/32 72/267
5,520,754 A * 5/1996 Yaney ..... C22C 1/0416 148/695
5,697,511 A * 12/1997 Bampton ..... B23K 20/1265 228/180.1
6,006,569 A * 12/1999 Shrayer ..... B21D 22/185 72/83
6,199,419 B1 * 3/2001 Shrayer ..... B21D 22/185 72/85
7,201,811 B2 * 4/2007 Babel ..... B23K 20/128 228/112.1
11,759,837 B1 * 9/2023 O'Hanley ..... B21D 5/008 29/897

FOREIGN PATENT DOCUMENTS

RU 2484915 C1 6/2013
RU 2715072 C1 2/2020

OTHER PUBLICATIONS

International Search Report for PCT/EP2023/075451, mailed Nov. 22, 2023, 5 pages.
Written Opinion of the ISA for PCT/EP2023/075451, mailed Nov. 22, 2023, 8 pages.
Search Report for FR2209363, dated Mar. 30, 2023, 2 pages.

* cited by examiner

METHOD FOR MANUFACTURING A LARGE-SIZED SEAMLESS DOME, AND CORRESPONDING DOME

This application is the U.S. national phase of International Application No. PCT/EP2023/075451 filed Sep. 15, 2023, which designated the U.S. and claims priority to FR Patent Application No. 2209363 filed Sep. 16, 2022, the entire contents of each of which are hereby incorporated by reference.

The present invention relates to a method for manufacturing a large-sized hollow piece in the shape of a dome.

Some large pressure tanks are constituted of two domes assembled by welding or with the addition of a cylindrical ring in between. The ends are constituted by bottoms or lids in form of a dome, fixed by bolting or welding to a cylindrical body.

These pressure tanks are, for example, high-pressure cryogenic tanks for liquefied gases such as liquid hydrogen, liquid oxygen or liquid nitrogen, for applications in the field of space launchers, terrestrial or mobile storage or in the domain of aeronautics.

To manufacture such pieces, it is known to shape several sheets machined by stamping to form petals, which are then assembled to form a corolla, then welded together to form the piece.

This technique presents the disadvantage of requiring a succession of costly operations. In particular, welding the assembly requires special, large-size equipment. In addition, rigorous ultrasonic inspection of the welds is required to ensure that the weld zones are sound and free from defects.

Single pieces in the form of a dome can also be manufactured by closed-die forging. This technique has the advantage of requiring only one shaping operation but has the disadvantage of being limited to small pieces, due to the limited dimensions of existing forging presses and the very high forces required to deform the material and fill the final piece.

The aim of the present invention is to remedy these drawbacks by proposing a method for manufacturing a piece in the shape of a dome such as a cryogenic tank dome, which does not require welding, and which can be realized on available forging presses the dimensions and/or capacities of which in terms of forces are limited.

To this end, the invention has as its object a method for manufacturing a hollow piece comprising a seamless, single (in one piece) wall in the shape of a dome extending around a central axis, the wall being realized of a material constituted of a metal alloy, the wall having an average thickness of less than 50 mm and a larger dimension, orthogonal to the central axis, of between 1500 mm and 3700 mm, the method comprising the following consecutive steps:

- providing a semi-finished product of said material;
- hot forging by upsetting the semi-finished product to form a blank with a developed surface greater than that of the semi-finished product and less than the developed surface of the wall;
- hot shaping of the blank to create a preform having a developed surface less than or equal to the developed surface of the wall, the preform comprising at least two consecutive portions extending radially in continuation with one another away from the central axis, so that for all the portions, the average thicknesses and/or convexities of two consecutive portions are distinct;
- hot deformation of the preform under a press between a die and a punch to form the wall.

Preferably, the method according to the invention may comprise one or more of the following features, taken alone or in any technically possible combination:

- the portions comprise a central portion and at least one intermediate annular portion, the central portion and the intermediate annular portion being of distinct convexities.
- the portions, in addition, comprise a peripheral annular portion, the peripheral annular portion having a convexity distinct from the convexity of the adjacent intermediate annular portion;
- the developed surface of the preform is substantially equal to the developed surface of the wall;
- a ratio between the projected surface of the preform on a transverse plane and the developed surface of the preform is less than 90%, and the largest dimension of the projected surface of the preform on a transverse plane is less than or equal to 150% of the largest dimension of the punch, orthogonal to the central axis;
- the step of deformation of the preform under the press comprises unfolding the preform between the die and the punch in such a way that, after unfolding, the surfaces of the portions facing the punch are concave;
- the surface of the central portion facing the punch has a concave shape;
- the step of hot-shaping the blank comprises:
  - A first phase of shaping by hot die forging the blank to produce a first concave blank;
  - A second phase of shaping by hot die forging the first concave blank to produce the preform;
- the second phase of shaping comprises a first intermediate phase of shaping by hot die forging of the first concave blank to produce a second blank comprising a concave central part and a convex peripheral part extending radially in continuation of the central part, and a second intermediate phase of shaping by hot die forging of the second blank to produce the preform;
- the portions comprise a central portion and at least one intermediate annular portion, the average thicknesses of the central portion and the intermediate annular portion being distinct, the developed surface of the preform being less than the developed surface of the wall;
- the portions, in addition, comprise a peripheral annular portion, and the intermediate annular portion is a thickened portion, the average thickness of the intermediate annular portion being greater than the average thickness of the central portion and the average thickness of the peripheral annular portion;
- the preform deformation step comprises a shaping phase during which at least a part of the intermediate annular portion is brought into contact with the die by the punch, and a die forging phase corresponding to an expansion during which at least part of the preform is not in contact with the punch;
- during the expansion phase, the thickened intermediate annular portion of the preform is compressed between the die and the punch, at least a part of the central portion and/or the peripheral annular portion not being in contact with the punch, so that the material flows plastically from the intermediate annular portion toward the central portion and the peripheral annular portion then beyond the peripheral annular portion to increase the developed surface of the preform and form the wall;
- the material is an aluminum alloy, in particular a 2XXX or 7XXX alloy.

The invention also has as its object a hollow piece comprising a single seamless wall in the shape of a dome, the wall extending around a central axis, the wall being realized in a material constituted of a metal alloy, the wall having an average thickness less than 50 mm and a larger dimension, orthogonal to the central axis, comprised between 1500 mm and 3700 mm.

Preferably, the wall presents a homogeneous fibering around the central axis, the orientation of the grain, also called fibers, of said metal alloy being such that in any transverse plane, the angle formed between the direction of elongation of a grain seen in cross-section in this transverse plane and the tangent to the wall at this grain is substantially constant.

The invention also has as its object a cryogenic tank comprising a piece such as defined above or manufactured by a method as defined above.

FIG. 1 is a schematic perspective view of a hollow piece in the shape of a dome according to one embodiment;

FIG. 2 schematically illustrates a method according to one embodiment;

FIG. 3 is a schematic view of a section in an axial plane of a preform according to a first embodiment;

FIG. 4 schematically illustrates a step for shaping a blank to form the preform of FIG. 3;

The hollow piece 1 comprises a single, seamless, wall 3 in the shape of a dome. By "wall" we mean a piece in its entire thickness, as opposed to the term "surface" or "face".

The wall 3 comprises a convex outer surface, oriented toward the outside of the dome, and a concave inner surface.

The wall 3 is seamless, devoid of welding, and is thus realized in one piece, being from a single piece of material.

The hollow piece 1 is intended, for example, to form an end dome of a pressure vessel of generally cylindrical shape.

The wall 3 extends around a central axis A-A, between two planes orthogonal to the central axis A-A, these two planes axially delimiting the wall 3.

In the following, as is the case in the Figures, we shall consider an axial direction oriented in such a way that, seen from top to bottom, the wall is concave in shape. Furthermore, a plane orthogonal to the central axis A-A will be referred to as "transverse" and a plane comprising this central axis A-A will be referred to as "axial".

Figure 1:
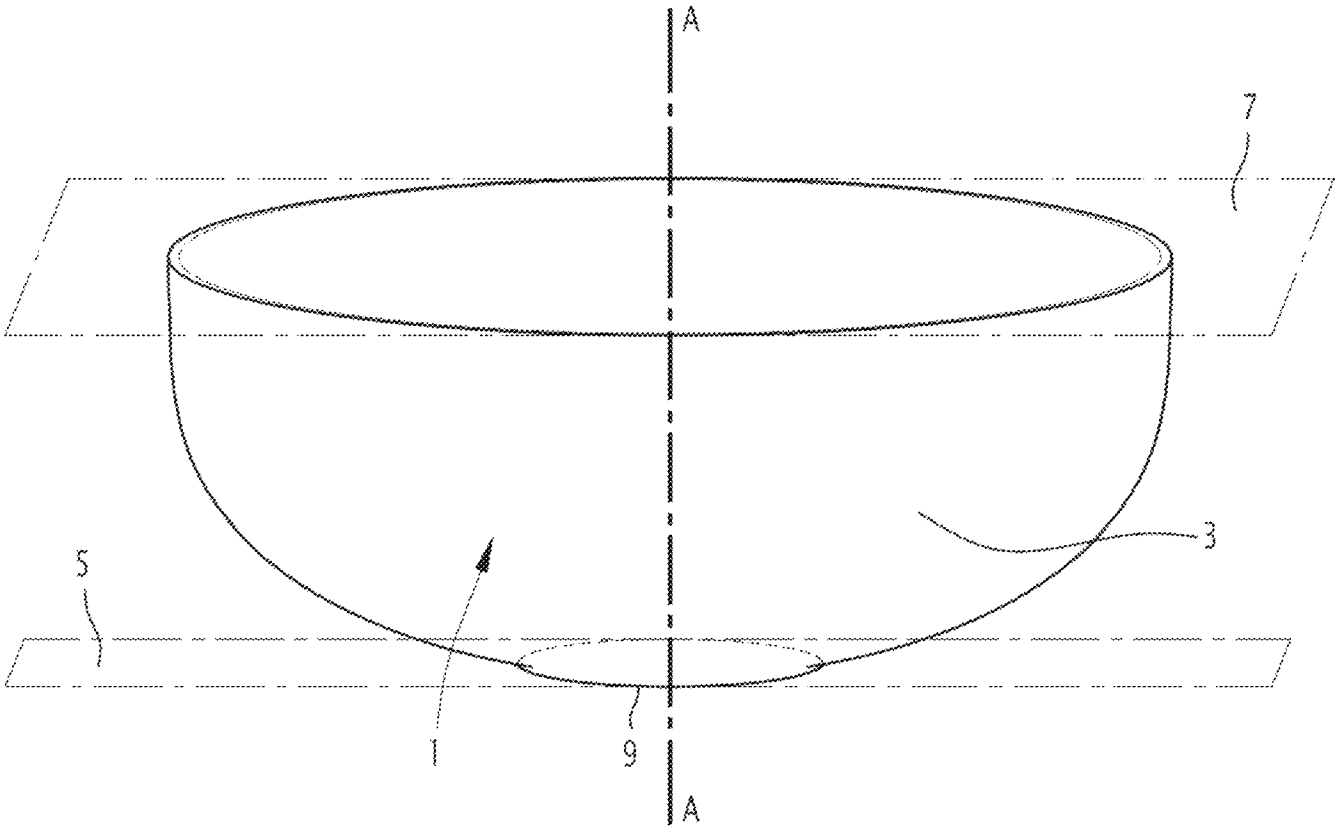
FIG. 1 represents a hollow piece 1 in the shape of a dome, according to one embodiment, according to an axial cross-section.
Figure 2:
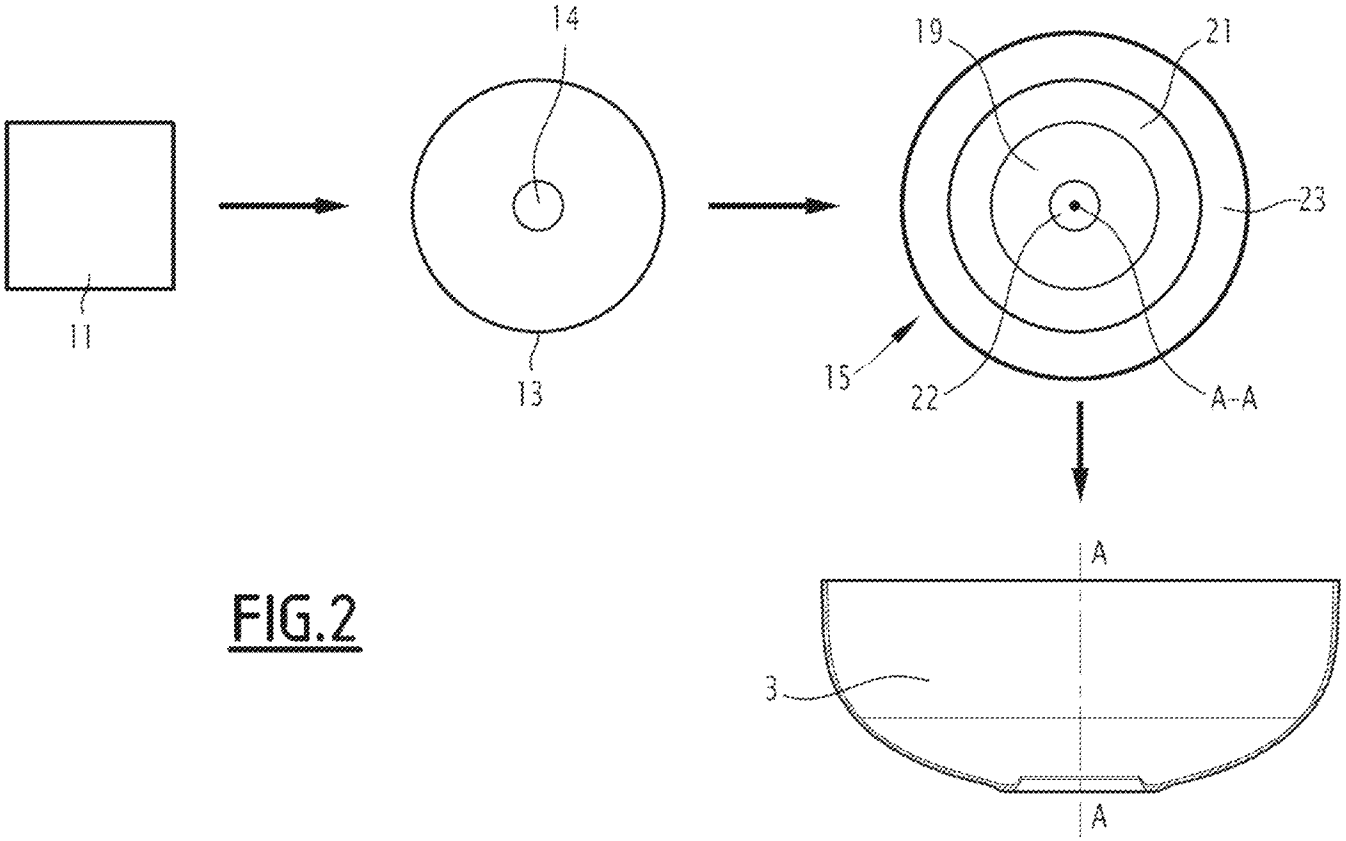

Thus, with reference to FIG. 1, the wall 3 extends between a lower transverse plane 5 and an upper transverse plane 7.

The wall 3, for example, has a form of revolution, in other words, such that the section of the wall 3 through any axial plane A is of constant form.

The wall 3 is, for example, substantially hemispherical or in the form of a spherical cap.

Alternatively, the wall 3 is in the form of an ellipsoidal cap, or in the form of a Cassini dome, Cassini cap, or more generally in the form of an ovoid cap.

The wall 3 presents a transverse section (in other words, in a plane orthogonal to the central axis A-A) in a curved form, for example circular, oval, particularly Cassini oval, or elliptical.

According to one embodiment, the wall 3 comprises a curved part such as an ellipsoidal cap, a Cassini dome, a Cassini cap, or an ovoidal cap, and a cylindrical or truncated cone shaped part in the continuation of the curved part.

The wall 3 is realized in a material constituted of a metal alloy.

The metal alloy is, for example, an aluminum alloy, in particular a 2XXX alloy such as alloy 2050 or alloy 2219, or a 7XXX alloy such as alloy 7020.

Alternatively, the metal alloy is a titanium alloy or steel.

The wall 3 has an average thickness of less than 50 mm, and generally greater than 25 mm, in particular greater than 30 mm.

The wall 3 has a larger dimension, orthogonal to the central axis A-A, of between 1500 mm and 3700 mm. By larger dimension means the largest dimension in any transverse plane, in other words, in the example represented in FIG. 1 the larger dimension in the upper transverse plane 7.

For example, if the wall 3 presents a circular transverse section, the largest dimension of the wall 3 is the diameter of the outer circle in the upper transverse plane 7. If the wall 3 has an elliptically formed transverse section, the largest dimension of the wall 3 is the large diameter of the outer ellipse in the upper transverse plane 7.

The wall 3 optionally comprises features arranged on the wall 3. These features are intended, for example, to connect equipment such as pipes. These features comprise for example, openings, reliefs on the outer surface of the wall 3, appendages, bulges, bosses, spigots and/or ribs. These features are preferably integrated into the wall 3, being of the same material as the wall, therefore realized during the manufacture of the wall 3.

In particular, the wall 3 preferably includes, in its lower part, a feature such as a tubular opening 9 centered on the central axis A-A. The opening 9 is, for example, circular, elliptical or ovoid form in section.

For example, the opening 9 is delimited by edges the thickness of which are greater than the average thickness of the wall 3.

With reference to FIGS. 2 to 6, a method for manufacturing such a hollow piece 1 according to one embodiment of the invention will now be described.

The method first comprises a step of supplying a semi-finished product 11 of the material from which the hollow piece 1 is realized.

The semi-finished product 11 (is for example a billet or slab of said material (such as seen from above in FIG. 2)). The semi-finished product 11 is obtained, for example, by casting said material.

The method then comprises a step of hot forging by upsetting of the semi-finished product 11 to form a blank 13. For example, in the example of FIG. 2, the substantially circular blank 13 is formed from the semi-finished product 11 by exerting pressure between the lower and upper faces of the semi-finished product 11.

The blank 13 presents a developed surface greater than that of the semi-finished product 11 and less than the developed surface of the wall 3 to be manufactured.

The hot forging step is realized at a temperature that depends on the material used. For example, if the material is an aluminum alloy, the hot forging step is generally realized at a temperature of between 300° C. and 500° C. If the material is a titanium alloy, the hot forging step is generally realized at a temperature of between 700° C. and 1300° C.

If the hollow piece 1 to be manufactured comprises an opening 9 such as described above, during this step a circular opening 14 is realized in the blank 13.

The blank 13 is then hot formed to create a preform 15.

The hot forming step is realized at a temperature that depends on the material used. For example, if the material is an aluminum alloy, the hot forming step is generally realized at a temperature of between 300° C. and 500° C. If the material is a titanium alloy, the hot forming step is generally realized at a temperature of between 700° C. and 1300° C.

The preform 15 has a developed surface that is either less than or equal to the developed surface of the wall 3.

The preform 15 comprises at least two consecutive portions extending radially in the continuation of one another away from the central axis A-A, so that for all the portions, the average thicknesses of a first and a second consecutive portion are distinct and/or the first portion is convex, concave or flat, while the second portion is, respectively, concave or flat, convex or flat, or convex or concave (in other words, if the first portion is convex, the second portion is concave or flat; if the first portion is concave, the second portion is convex or flat; if the first portion is flat, the second portion is convex or concave).

As described below, the preform 15 is then hot deformed under a press between a die and a punch to form the wall 3 of the hollow piece 1.

By convex or concave, means a portion such that the surface of the portion under consideration intended to face the punch during hot deformation is convex, respectively concave, the opposite surface being concave, respectively convex.

Furthermore, only two portions will, hereafter, be considered to be of distinct convexity if one of the portions is concave and the other is convex, or if one of the portions is flat and the other is convex, or if one of the portions is concave and the other is flat.

The preform 15 therefore comprises at least two consecutive portions, extending radially in the continuation of one another away from the central axis A-A, so that for all these portions, the average thicknesses and/or convexities of two consecutive portions are distinct.

By distinct average thicknesses, is meant that the average thickness of a first portion according to at least one axial cross-section and the average thickness of a second portion according to this axial cross-section are such that the ratio between the greatest average thickness and the least average thickness is greater than or equal to 1.2, preferably greater than or equal to 1.3, better still greater than or equal to 1.5, or even greater than or equal to 2. Generally, this ratio is less than or equal to 5. In other words, the greatest average thickness is greater than or equal to 120%, preferably 130%, better still 150% or even 200% of the least thickness, but remains less than or equal to 500% of the least thickness.

Thus, the preform 15 comprises a central portion 19 and at least one annular portion 21 extending radially in the continuation of one another away from the central axis A-A, the central portion 19 and the annular portion 21 having distinct convexities and/or distinct average thicknesses.

If the central portion 19 and the annular portion 21 are of distinct convexities, the central portion 19 is generally concave, the adjacent annular portion 21 being convex.

If the central portion 19 and the annular portion 21 are of distinct average thicknesses, the central portion 19 is generally of lower average thickness than the average thickness of the adjacent annular portion 21.

If the hollow piece 1 to be manufactured comprises an opening 9, the central portion 19 is an annular portion. The central portion 19 thus comprises a recess 22. This recess 22 is intended to form the opening 9 of the hollow piece 1.

Preferably, the preform 15 includes a plurality of consecutive portions 19, 21, 23 . . . extending radially in the continuation of one another away from the central axis A-A, so that for all the portions, the average thicknesses and/or convexities of two consecutive portions are distinct.

The central portion 19 generally has a developed surface of between 5% and 90% of the developed surface of the preform 15.

If the preform comprises only two portions, the annular portion 21 therefore has a developed surface of between 10% and 95% of the developed surface of the preform 15.

In addition, if N is the number of portions constituting the preform 15, with N≥3, each annular portion has a developed surface of between 10%/(N−1) and 100%/(N−1) of the developed surface of the preform 15.

Each considered portion differs from each adjacent portion in that the average thickness of the considered portion is distinct from the average thickness of this adjacent portion and/or in that the convexity of the considered portion is distinct from the convexity of this adjacent portion.

For example, the portions present distinct consecutive convexities.

Preferably, the preform 15 then includes a succession of at least three alternately concave and convex portions 19, 21, 23, which form a wave-like pattern. In this case, the central portion preferably has a developed surface of between 10% and 90% of the developed surface of the preform 15, and each annular portion preferably has a developed surface of between 10%/(N−1) and 50%/(N−1) of the developed surface of the preform 15.

According to another example, the portions present distinct consecutive average thicknesses.

According to yet another example, at least one portion presents a convexity identical to the convexity of a first adjacent portion, but an average thickness distinct from the average thickness of the first adjacent portion and presents a convexity distinct from the convexity of a second adjacent portion, but an average thickness identical to the average thickness of the second adjacent portion.

In particular, the preform comprises a central portion 19, an intermediate annular portion 21 extending radially in the continuation of the central portion 19 away from the central axis A-A, and a peripheral annular portion 23 extending radially in the continuation of the intermediate annular portion 21 away from the central axis A-A, the intermediate annular portion 21 presenting an average thickness different from the average thicknesses of the central portion 19 and the peripheral annular portion 23, and/or a convexity different from the convexity of the central portion 19 and the peripheral annular portion 23.

Figure 3:
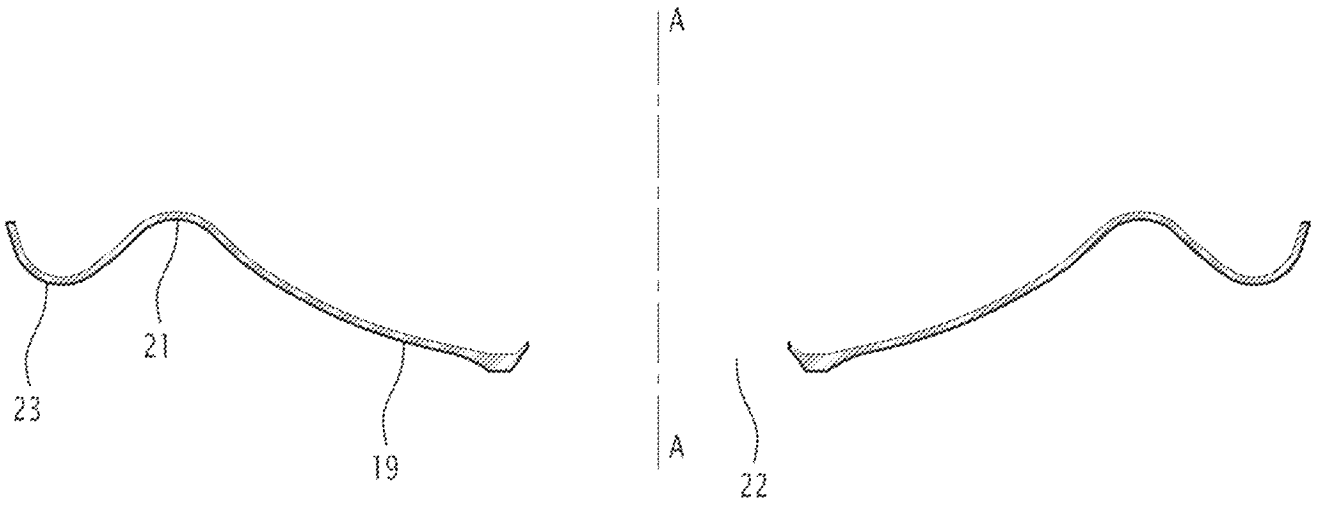

In a first embodiment, of which FIG. 3 illustrates an example, the preform 15 is such that the portions comprise a central portion 19 and at least one intermediate annular portion 21, the central portion 19 and the intermediate annular portion 21 being of distinct convexities.

Preferably, as illustrated in FIG. 3, the portions, in addition, comprise a peripheral annular portion 23, the peripheral annular portion 23 having a convexity distinct from the convexity of the intermediate annular portion 21 adjacent thereto. The preform 15 then includes a succession of at least three alternately concave and convex portions, which form a wave-like pattern.

In the example illustrated in FIG. 3, the preform 15 comprises a single intermediate annular portion 21.

Thus, the central portion 19, the intermediate annular portion 21 and the peripheral annular portion 23 extend radially in the continuation of one another, away from the central axis A-A, the central portion 19 being adjacent to the intermediate annular portion 21 and the intermediate annular portion 21 being adjacent to the central portion 19 and the peripheral annular portion 23.

The central portion 19, has for example, a developed surface of between 50% and 90% of the developed surface of the preform 15.

The intermediate annular portion 21 has, for example, a developed surface of between 5% and 25% of the developed surface of the preform 15.

The peripheral annular portion 23 has, for example, a developed surface of between 5% and 25% of the developed surface of the preform 15.

In this example, the central portion 19 is an annular portion and includes a recess 22.

In one alternative, the preform comprises at least two intermediate annular portions. In this first embodiment, for all portions, the convexities of two consecutive portions are distinct. For example, if the preform comprises a central portion, a first intermediate annular portion, a second intermediate annular portion and a peripheral annular portion successively extending radially in the continuation of each other away from the central axis A-A, the first intermediate annular portion has a convexity distinct from the convexity of the central portion and the second intermediate annular portion, and the peripheral annular portion has a convexity distinct from that of the second intermediate annular portion.

Preferably, in this first embodiment, and as illustrated in FIG. 3, the surface of the central portion 19 facing the punch (in other words, viewed from top to bottom) has a concave shape.

In the example illustrated in FIG. 3, the intermediate annular portion 21 is convex, while the central portion 19 and the peripheral annular portion 23 are concave.

In this example, the average thicknesses of the central portion 19, the intermediate annular portion 21 and the peripheral annular portion 23 are substantially identical, in other words, such that the ratio between the greatest average thickness and the least thickness is less than 1.2.

In this first embodiment, the developed surface of the preform 15 is generally substantially equal to the developed surface of the wall 3.

Thus, hot deformation of the preform 15 to form the wall 3 is realized without variation in thickness and therefore requires limited force.

In addition, due to the alternation of concave and convex portions, the projected surface of the preform 15 on a transverse plane is less than the developed surface of the preform 15.

The ratio between the projected surface of the preform 15 on a transverse plane and the developed surface is generally less than 90%, preferably less than 80%, more preferably less than 50%, and the largest dimension of the projected surface of the preform on a transverse plane is less than or equal to 150% of the largest dimension of the punch orthogonal to the central axis A-A, in particular less than or equal to 135% of the largest dimension of the punch orthogonal to the central axis A-A, preferably less than or equal to 120% of the largest dimension of the punch orthogonal to the central axis A-A.

It is therefore possible to realize a hollow piece 1 of large dimension using a press of limited size, in particular at least 10%, preferably at least 20%, still better at least 50% less than the size that would have been necessary to stamp a flat preform with a developed surface equal to the developed surface of the wall 3.

Figure 4:
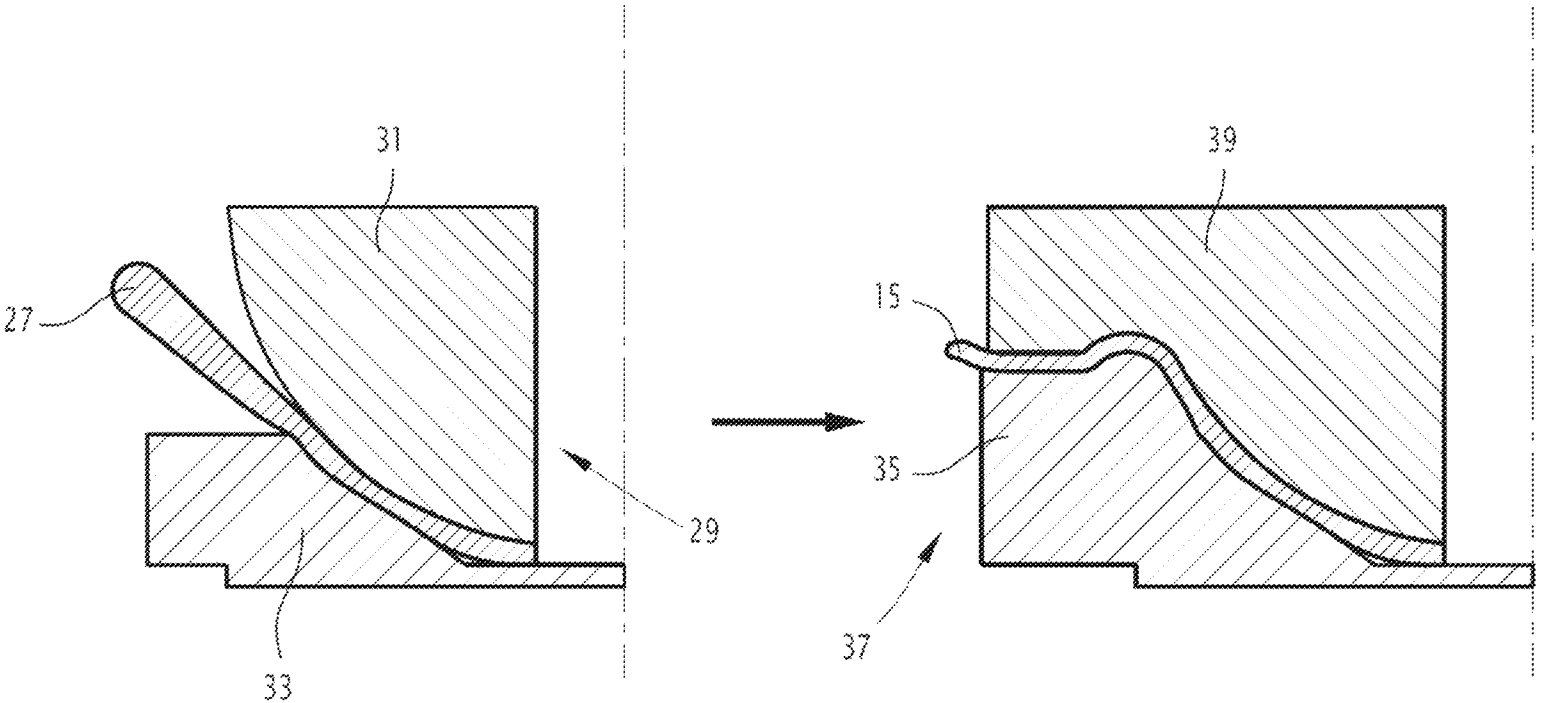

FIG. 4 illustrates a step for shaping the blank 13 to form the preform 15 according to this first embodiment.

In the example illustrated in FIG. 4, the step of hot shaping the blank to form the preform 15 comprises a first phase of shaping by hot die forging or stamping the blank 13 to produce a first concave blank 27.

This first shaping phase is preferably a phase of shaping by upsetting the material toward the periphery of the blank 13, in such a way that the developed surface of the first concave blank 27 is greater than the developed surface of the blank 13.

The hot forming step then comprises a second phase of hot forming by hot die forging or hot stamping the first concave blank 27 to produce the preform 15.

During this step, a peripheral part of the first concave blank 27 is deformed to form the intermediate annular portion 21 and the peripheral annular portion 23.

Preferably, during this second shaping phase, the material is again upset, toward the periphery of the first concave blank 27, in such a way that the developed surface of the preform 15 is greater than the developed surface of the first concave blank 27.

Preferably, the first and second shaping phases are implemented by means of a first auxiliary press 29 and a second auxiliary press 37 respectively.

As illustrated in FIG. 4, the first auxiliary press 29 comprises a first die 33 and a first punch 31.

The first shaping phase is preferably implemented by hot die forging or stamping the blank 13 between the first die 33 and the first punch 31.

The second shaping phase is implemented in the second auxiliary press 37 between a second die 35 and a second punch 39.

The shapes of the second die 35 and the second punch 39 are able to shape the preform 15, in particular the intermediate 21 and the peripheral 23 annular portions.

The second shaping phase is then implemented by die forging or stamping the first concave blank 27 between the second die 35 and the second punch 39.

According to one alternative, the second shaping phase comprises a first intermediate shaping phase by hot die forging or stamping the first concave blank to produce a second blank comprising a concave central part and a convex peripheral part extending in the continuation of the central part, and a second intermediate hot shaping phase by die forging or stamping the second blank to produce the preform.

Figure 5:
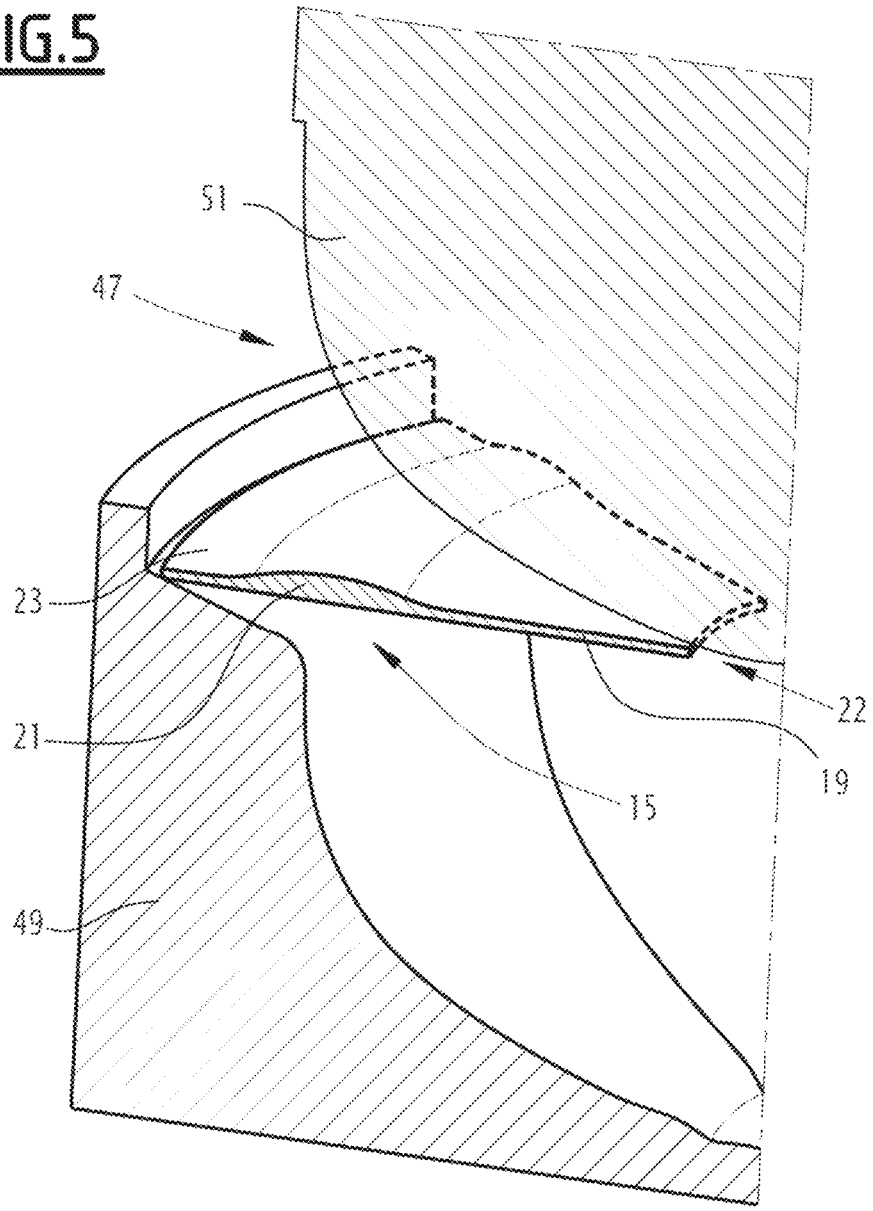
FIG. 5 is a schematic perspective view of a preform according to a second embodiment, prior to its hot deformation under a press.

FIG. 5 illustrates an example of a preform 15 according to a second embodiment. This figure represents only a portion of the preform 15, according to a perspective view. In addition, on this FIG. 5 the press 47 has been represented, including the die 49 and the punch 51, just before the preform 15 is hot deformed.

In this second embodiment, the preform 15 is such that the portions comprise a central portion 19 and at least one intermediate annular portion 21, the average thicknesses of the central portion 19 and the intermediate annular portion 21 being distinct.

The developed surface of the preform 15 is less than the developed surface of the wall 3.

In addition, a ratio between the projected surface of the preform 15 on a transverse plane and the developed surface of the preform 15 is generally greater than 90%. Furthermore, the largest dimension of the projected surface of the preform 15 on a transverse plane is smaller than or equal to 150% of the largest dimension of the punch 51, preferably less than or equal to 120% of the largest dimension of the punch 51 orthogonal to the central axis A-A.

The portions comprise at least one thickened portion intended to provide a surplus of material which will be used during the step of hot deformation to increase the developed surface of the preform 15 by plastic flow.

Preferably, as illustrated in FIG. 5, the portions in addition comprise a peripheral annular portion 23, the peripheral annular portion 23 having an average thickness distinct from the average thickness of the intermediate annular portion 21 adjacent thereto. The preform 15 then comprises a succession of at least three portions of distinct successive average thicknesses.

In the example illustrated in FIG. 5, the preform 15 comprises a single intermediate annular portion 21.

Thus, the central portion 19, the intermediate annular portion 21 and the peripheral annular portion 23 extend radially in the continuation of one another, away from the central axis A-A, the central portion 19 being adjacent to the intermediate annular portion 21 and the intermediate annular portion 21 being adjacent to the central portion 19 and the peripheral annular portion 23.

The central portion 19, for example, has a developed surface of between 5% and 90% of the developed surface of the preform 15.

The intermediate annular portion 21, for example, has a developed surface of between 5% and 50% of the developed surface of the preform 15.

The peripheral annular portion 23, for example, has a developed surface of between 5% and 50% of the developed surface of the preform 15.

In this example, the central portion 19 is an annular portion and includes a recess 22.

In addition, in this example, the intermediate annular portion 21 presents an average thickness distinct from the average thickness of the central portion 19 and from the average thickness of the peripheral annular portion 23.

In particular, the intermediate annular portion 21 is a thickened portion, in other words, with an average thickness greater than the average thickness of the central portion 19 and the average thickness of the peripheral annular portion 23.

In this example, the average thicknesses of the central portion 19, the intermediate annular portion 21 and the peripheral annular portion 23 are such that the ratio between the greatest average thickness and the least thickness is greater than or equal to 1.2, preferably greater than or equal to 1.3, more preferably greater than or equal to 1.5, or even greater than or equal to 2. Preferably, this ratio is less than or equal to 5.

Shaping of the blank 13 to form the preform 15 is realized, for example, by upsetting, by means of die rings or flat disks.

After the step of hot forming the blank 13 to create the preform 15, the method comprises a step of hot deformation of the preform 15 under a press 47 between a die 49 and a punch 51 to form the wall 3.

The step of hot deformation is realized at a temperature that depends on the material used. For example, if the material is an aluminum alloy, the step of hot deformation is generally realized at a temperature of between 300° C. and 500° C. If the material is a titanium alloy, the step of hot deformation is generally realized at a temperature of between 700° C. and 1300° C.

Generally, the die 49 has a larger diameter less than the largest diameter of the developed surface of the wall 3.

The step of hot deformation comprises stamping and, optionally, die forging of the preform 15 to form the wall 3.

During stamping, the shape of the preform 15 is modified to assume the shape of the contours of the die 49 and/or the punch 51 without any significant variation in thickness.

During die forging, the wall 3 is shaped, the local and average thicknesses being modified.

In the first embodiment described above, in which the preform 15 comprises at least two portions of distinct convexity, the step of hot deformation comprises stamping.

In particular, if the developed surface of the preform 15 is equal to the developed surface of the wall 3, the step of hot deformation consists of stamping.

In particular, the step of hot deformation comprises unfolding the preform 15 between the die 49 and the punch 51 in such a way that, after unfolding, the surfaces of the convex portions of the preform facing the punch 51 become concave.

In particular, in the example illustrated in FIG. 3, the preform 15 is unfolded during the hot deformation step so that the surface of the intermediate annular portion 21 facing the punch 51 becomes concave.

If the preform 15 has a developed surface equal to the developed surface of the wall 3, this step of hot deformation does not involve any change in thickness. Thus, such a step requires reduced pressing forces.

In addition, the projected surface of the preform 15 on a transverse plane being less than the developed surface of the preform 15, it is possible, during this step, to realize a hollow piece 1 of large dimension by means of a press of limited size, in particular at least 50% smaller than the size that would have been necessary to stamp a flat preform with a developed surface equal to the developed surface of the wall 3.

Figure 6:
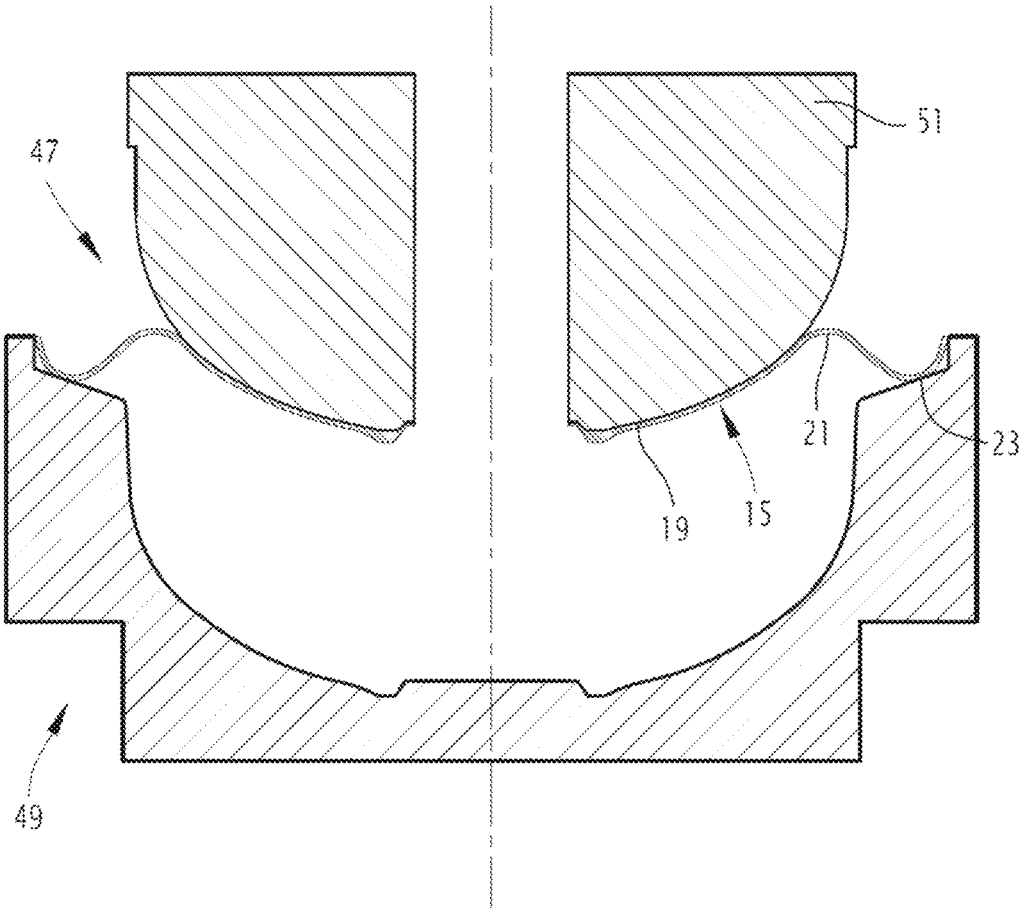
FIG. 6 is a schematic view of a cross-section according to an axial plane of an initial phase of a step of hot deformation of the preform of FIG. 3.

FIG. 6 represents schematically, by way of example, an initial phase of a step of hot deformation for the preform 15 of FIG. 3.

As illustrated in this Figure, the deformation step comprises an initial phase of bringing the punch 51 into contact with the preform 15, in particular with the central portion 19.

The punch 51 then continues its stroke, causing the preform 15 to unfold, in such a way that the convexity of the intermediate annular portion 21 is reversed, the intermediate annular portion 21 becoming concave. At the end of the punch stroke, the surfaces of the wall 3 in contact with the punch are concave.

In the second embodiment described above, in which the preform 15 comprises at least two portions of distinct average thicknesses, the step of hot deformation comprises, for example, die forging and stamping the preform 15 between the die 49 and the punch 51.

In particular, the stamping of the preform 15 comprises a shaping phase during which the preform 15 is brought into contact with the die 49 by the punch 51.

At the end of this phase, for example, the lower surfaces of at least one portion of the preform 15, preferably all the portions of the preform, are in contact with the die 49, and the upper surface of the at least one portion is not in contact with the punch 51. Preferably, at the end of this phase, at least part of the intermediate annular portion 21 is in contact with the die 49 and the punch 51.

Alternatively, at the end of this phase, the upper surfaces of the at least one portion of the preform 15, preferably all the portions of the preform 15, is/are in contact with the punch 51, and the lower surface of the at least one portion is not in contact with the die 49.

Die forging is an expansion phase, during which the material is upset until the material assumes the shape of the surfaces of the punch 51 and the die 49.

According to one embodiment, during this phase, as long as the expansion is not complete, at least a portion of the preform 15 is not in contact with the punch 51.

Thus, the forces to be exerted by the press are reduced. In addition, the projected surface of the preform 15 on a transverse plane is less than the developed surface of the preform 15, it is possible to realize a hollow piece 1 of large dimension using a press of limited size, in particular at least 50% less than the size that would have been required to stamp a flat preform with a developed surface equal to the developed area of the wall 3.

In the example illustrated in FIG. 5, during the expansion phase, the thickened intermediate annular portion 21 of the preform 15 is compressed between the die 49 and the punch 51, with at least part of the central portion 19 and/or the peripheral annular portion 23 not in contact with the punch 51. Thus, the material flows plastically from the intermediate annular portion 21 toward the central portion 19 and the peripheral annular portion 23 then beyond the peripheral annular portion 23 to increase the developed surface of the preform 15 and form the wall 3.

The method according to the invention thus allows to manufacture a large-sized piece in the shape of a dome, such as a cryogenic tank dome, which does not require welding, which can be realized on available forging presses the dimensions of which are limited and in particular the largest diameter of which is less than the largest diameter of the developed surface of the wall 3, and/or the capacities of which in terms of force are limited.

Figure 7:
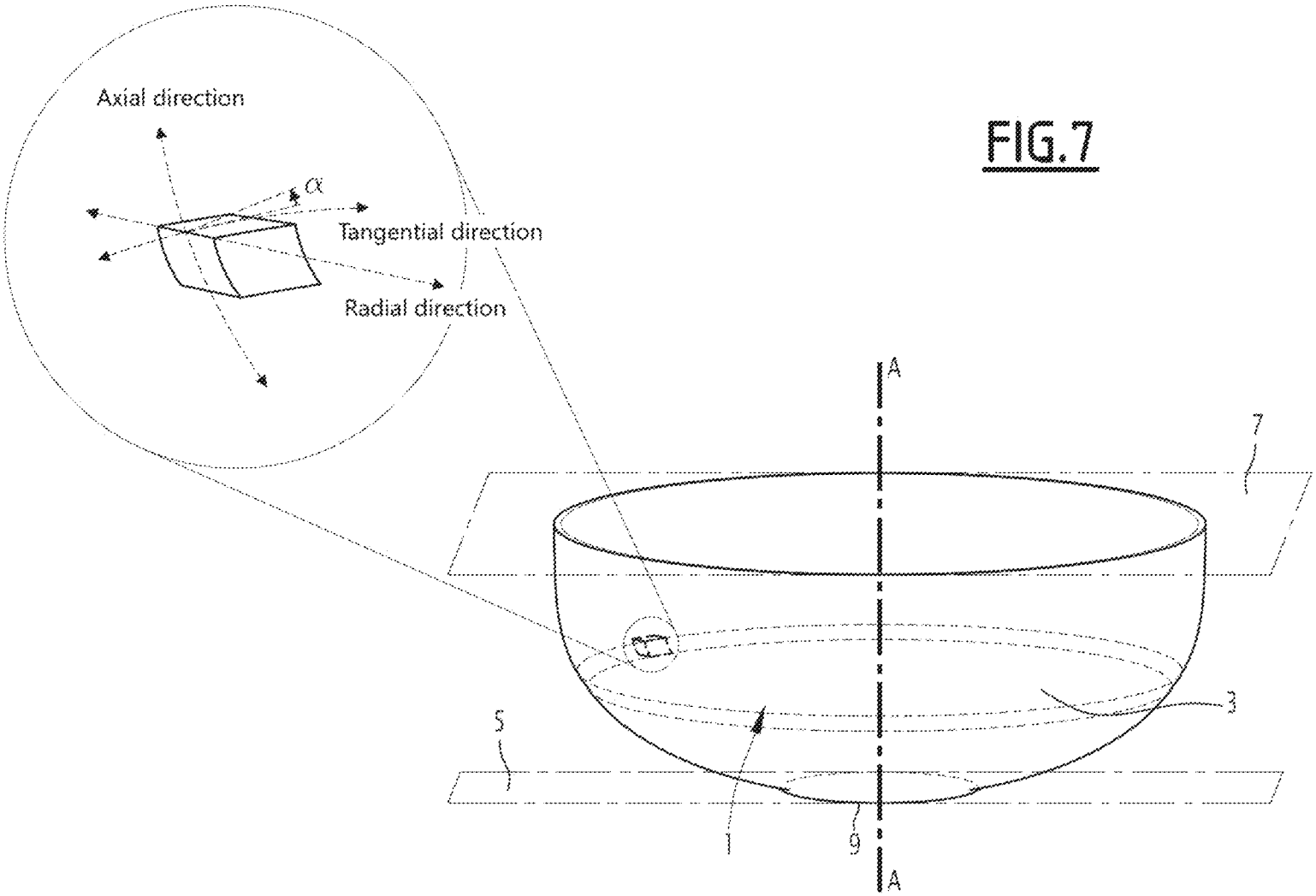
FIG. 7 illustrates the orientation of the grains in the hollow piece of FIG. 1.

In addition, it is possible to realize, by this method, a piece the grain of which is homogeneous, in such a way that the mechanical characteristics of the piece are homogeneous around the central axis A-A and along the wall 3, from the lower transverse plane 5 toward the upper transverse plane 7, as illustrated in FIG. 7.

In particular, the orientation of the grains is homogeneous, both around the central axis, in any axial plane comprising the axis A-A and in any plane transverse to the axis A-A.

Generally, in any transverse plane, the angle $\alpha$ formed between the direction of elongation of the grains (long direction) seen in cross-section in this transverse plane and the tangent to the surface of the wall at this grain, as illustrated in FIG. 7, is substantially constant (for example +/−10°).

Indeed, the grains elongate in a preferred direction as a result of the deformations applied by the method according to the invention.

The direction of elongation of a grain seen in cross-section in the transverse plane means that the direction in which the largest dimension (length) of a grain seen in cross-section in this transverse plane extends.

The thesis "Comportement et endommagement des alliages d'aluminium 6061-T6: Approche micromécanique", Yang Shen, 2012, illustrates in particular the microstructural characterization of grains, in particular the direction of elongation.

As far as fiberization is concerned, the tangential direction is preferably more pronounced than the axial direction, and the axial direction is more pronounced than the radial direction, which means that in general, grains are more elongated in the tangential direction than in the axial direction, and more elongated in the axial direction than in the radial direction. "Radial direction" here, generally means a direction that extends through the thickness of the wall, or in other words, according to the thickness, perpendicular to a plane tangential to the wall (and therefore not necessarily perpendicular to the axis A-A).

Generally speaking, if it is considered that the grains are viewed in three dimensions, the greatest direction of grain elongation is tangential, comprised in the transverse plane and tangential to the surface of the wall 3 (in other words, the angle $\alpha$ formed between the direction of grain elongation seen in cross-section in this transverse plane and the tangent to the surface of the wall at this grain is substantially zero).

The mechanical properties of the piece obtained are higher in the tangential direction, which is the highest stress mode for this type of piece.

The grains are preferably symmetrical around the central axis A-A.

Generally speaking, the person skilled in the art will be able to adapt the geometry of the preform and the dimensions of the different portions thereof, in particular the diameters and thicknesses, as well as the number of portions, depending on the shape and dimensions of the wall to be manufactured, and depending on the maximum dimensions and capacities of the press.

Furthermore, the method is not limited to the manufacture of domes of large dimensions for pressure vessels. It can be adapted to any piece of large dimension able to be manufactured by stamping/die forging.

The piece that can be manufactured by this method is generally, but not necessarily, a piece of revolution. The wall can also comprise additional features, such as openings, surface reliefs, in particular bosses, pits and ribs.

Furthermore, the two embodiments described above can be combined. In particular, with reference to the first embodiment, at least one portion has an average thickness distinct from the average thickness of another portion.

The invention claimed is:

1. A method for manufacturing a hollow piece comprising a single seamless wall in a shape of a dome extending around a central axis, the wall being made of a material constituted of a metal alloy, the wall having an average thickness of less than 50 mm and a larger dimension, orthogonal to the central axis, of between 1500 mm and 3700 mm, the method comprising the following consecutive steps:

providing a semi-finished product of said material;

hot forging by upsetting the semi-finished product to form a blank with a developed surface greater than a developed surface of the semi-finished product and less than a developed surface of the wall;

hot forming of the blank to create a preform having a developed surface less than or equal to the developed surface of the wall, the preform comprising at least two consecutive portions extending radially in the continuation with one another away from the central axis, so that for all the portions, an average thicknesses and/or convexities of two consecutive portions are distinct;

hot deformation of the preform under a press between a die and a punch to form the wall.

2. The method for manufacturing according to claim 1, wherein the portions comprise a central portion and at least one intermediate annular portion, the central portion and the intermediate annular portion being of distinct convexities.

3. The method for manufacturing according to claim 2, wherein the portions further comprise a peripheral annular portion, the peripheral annular portion having a convexity distinct from a convexity of an adjacent intermediate annular portion.

4. The method for manufacturing according to claim 2, wherein a ratio between a projected surface of the preform on a transverse plane and a developed surface of the preform is less than 90%, and a largest dimension of the projected surface of the preform on a transverse plane is less than or equal to 150% of a largest dimension of the punch orthogonal to the central axis.

5. The method for manufacturing according to claim 2, wherein the step of deformation of the preform under the press comprises unfolding the preform between the die and the punch in such a way that, after unfolding, surfaces of the portions facing the punch are concave.

6. The method for manufacturing according to claim 2, wherein a surface of the central portion facing the punch has a concave shape.

7. The method for manufacturing according to claim 1, wherein the portions comprise a central portion and at least one intermediate annular portion, an average thicknesses of the central portion and of the intermediate annular portion being distinct, a developed surface of the preform being less than the developed surface of the wall.

8. The method for manufacturing according to claim 7, wherein the portions further comprise a peripheral annular portion, and the intermediate annular portion is a thickened portion, the average thickness of the intermediate annular portion being greater than the average thickness of the central portion and an average thickness of the peripheral annular portion.

9. The method for manufacturing according to claim 8, wherein the step of deformation of the preform comprises a shaping phase during which at least part of the intermediate annular portion is brought into contact with the die by the punch, and a die forging phase corresponding to an expansion during which at least part of the preform is not in contact with the punch.

10. The method for manufacturing according to claim 9, wherein during the expansion phase, the thickened intermediate annular portion of the preform is compressed between the die and the punch, at least part of the central portion and/or of the peripheral annular portion not being in contact with the punch, in such a way that the material flows plastically from the intermediate annular portion toward the central portion and the peripheral annular portion then beyond the peripheral annular portion to increase the developed surface of the preform and form the wall.

11. The method according to claim 1, wherein the material is an aluminum alloy.

12. The method according to claim 11, wherein the aluminum alloy is a 2XXX alloy.

13. The method according to claim 11, wherein the aluminum alloy is a 7XXX alloy.

14. A hollow piece comprising a single seamless wall in a shape of a dome, the wall extending around a central axis, the wall being realized of a material constituted of a metal alloy, the wall having an average thickness of less than 50 mm and a larger dimension, orthogonal to the central axis, of between 1500 mm and 3700 mm, wherein the wall presents a homogeneous fibering around the central axis, an orientation of grains of said metal alloy being such that in any transverse plane, an angle formed between a direction of elongation of a grain seen in cross-section in the transverse plane, and a tangent to the wall at the grain is substantially constant.

15. A cryogenic tank comprising a hollow piece according to claim 14.

16. The hollow piece according to claim 14, wherein the material is an aluminum alloy.

17. The hollow piece according to claim 16, wherein the aluminum alloy is a 2XXX alloy.

18. The hollow piece according to claim 16, wherein the aluminum alloy is a 7XXX alloy.

* * * * *